United States Patent [19]

Bryers et al.

[11] 4,183,330

[45] Jan. 15, 1980

[54] FAST FLUIDIZED BED STEAM GENERATOR

[75] Inventors: Richard W. Bryers, Flemington; Thomas E. Taylor, Bergenfield, both of N.J.

[73] Assignee: Foster Wheeler Development Corporation, Livingston, N.J.

[21] Appl. No.: 865,289

[22] Filed: Dec. 28, 1977

[51] Int. Cl.[2] ..... F22B 1/02; F23D 19/02

[52] U.S. Cl. ..... 122/4 D; 110/245

[58] Field of Search ..... 122/4 D; 110/245

[56] References Cited

U.S. PATENT DOCUMENTS

| | | | |
|---|---|---|---|
| 3,387,590 | 6/1968 | Bishop | 122/4 |
| 3,431,892 | 3/1969 | Godel | 122/4 |
| 3,736,908 | 6/1973 | Ehrlich et al. | 122/4 |
| 3,763,830 | 10/1973 | Robinson et al. | 122/4 |
| 3,991,816 | 11/1976 | Klaren | 122/4 |

FOREIGN PATENT DOCUMENTS

| | | | |
|---|---|---|---|
| 1264345 | 2/1972 | United Kingdom | 122/4 |

*Primary Examiner*—Kenneth W. Sprague

*Attorney, Agent, or Firm*—Marvin A. Naigur; John E. Wilson; John Herguth

[57] ABSTRACT

A steam generator in which a high-velocity, combustion-supporting gas is passed through a bed of particulate material to provide a fluidized bed having a dense-phase portion and an entrained-phase portion for the combustion of fuel material. A first set of heat transfer elements connected to a steam drum is vertically disposed above the dense-phase fluidized bed to form a first flow circuit for heat transfer fluid which is heated primarily by the entrained-phase fluidized bed. A second set of heat transfer elements connected to the steam drum and forming the wall structure of the furnace provides a second flow circuit for the heat transfer fluid, the lower portion of which is heated by the dense-phase fluidized bed and the upper portion by the entrained-phase fluidized bed.

23 Claims, 5 Drawing Figures

FIG. 2.
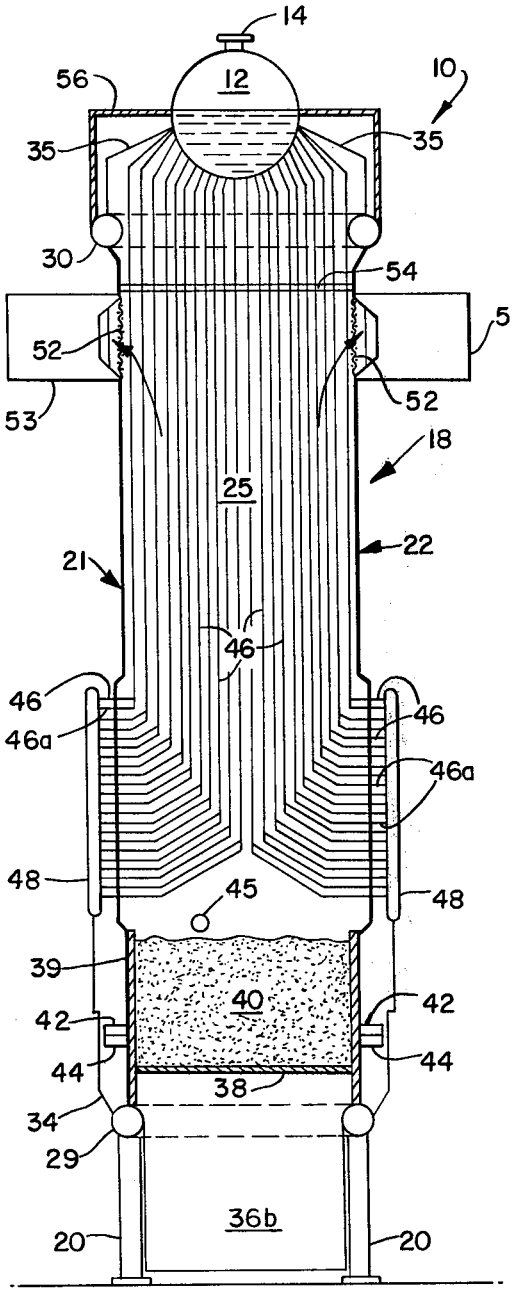
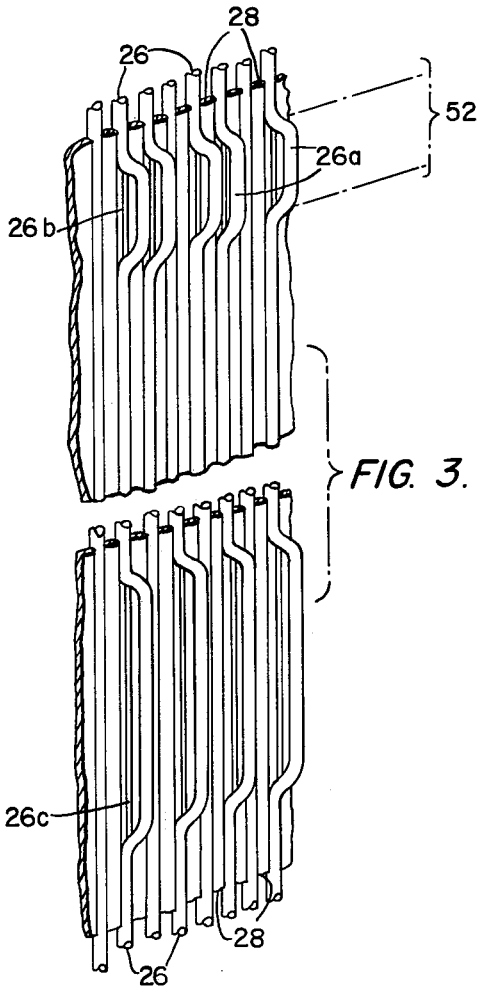
FIG. 3.

FAST FLUIDIZED BED STEAM GENERATORBACKGROUND OF THE INVENTION

This invention relates generally to heat exchange systems and, more particularly, to a natural-circulation steam generator in which a fast-fluidized bed process provides the heat for generating steam.

The use of fluidized beds has been recognized as an attractive means of generating heat. In these arrangements, air is passed through a bed of particulate materials, including a particulate fossil fuel such as coal, to fluidize the bed and to promote the combustion of the fuel. When the heat produced by the fluidized bed is utilized to convert water to steam, such as in a steam generator, the fluidized bed system offers and attractive combination of high heat release, improved heat transfer to surfaces within the bed, and compact boiler size.

Typically, in a conventional fluidized bed system, a layer or a bed of particulate materials is supported by an air distribution plate, to which combustion-supporting air is introduced through a plurality of perforations in the plate, causing the material to expand and take on a suspended or fluidized state. A plurality of heat transfer tubes are normally disposed horizontally with the fluidized bed and a plurality of heat transfer tubes are disposed above the fluidized bed. The heat produced by the fluidized bed is transferred to a heat exchange medium, such as water, circulating through the tubes. The heat transfer tubes within the fluidized bed are connected to the tubes above the bed in a discontinuous fashion by interconnecting piping and headers positioned exteriorly of the combustion chamber. This arrangement permits balancing the requirements of the heat transfer surfaces disposed within and outside the fluidized bed without disrupting the operating conditions normally imposed upon the circulating heat exchange medium.

The use of horizontally-disposed, heat transfer tubes presents problems related to low-load operation of the steam generator. Low-load, or reduced-load, operation is limited to approximately 60% of full load to avoid prolonged overheating of the heat transfer surfaces. During load reduction, the amount of heat transfer surfaces and the heat transfer coefficient of such surfaces remain unchanged. However, since the amount of heat absorbed by the heat transfer surfaces is reduced, the temperature differential between the fluidized bed and the heat transfer surfaces must also be reduced. Since only a small reduction in the temperature of the fluidized bed can be tolerated in order to sustain fuel combustion and the sulfur-recovery process, the temperature of the heat transfer surfaces rises during reduced-load operations. In order to limit this temperature rise, the extent of reduced-load operation is accordingly limited.

The use of vertically-disposed, heat transfer tubes resolves some of the aforesaid problems associated with horizontally-disposed tubes. Typically, a plurality of vertically-disposed tubes extend through openings provided in the air distribution plate supporting the fluidized bed, such that a portion of the tubes are immersed within the bed and the remaining portion extends in a continuous fashion into the convection zone above the bed. Vertically-disposed tubes do not present the circulation obstruction problem associated with horizontally-disposed tubes. However, the large amount of heat transfer surfaces extending above the fluidized bed presents a problem in achieving the proper balance between the immersed and the non-immersed vertical, heat transfer surfaces. One means of achieving this balance involves minimizing the effective length of the tube surfaces exposed to the hot gases above the bed by connecting each tube in the bundle in a serpentive manner. The resulting tube bundle is more costly to produce, and the heat transfer fluid cannot be drained from the tubes.

Another approach with vertically-disposed tubes involved the redistribution of heat transfer surfaces in such a manner as to render the enclosure wall of the steam generator ineffective as a heat exchanger surface, or required the heat transfer fluid to be supplied to the immersed portion of the tubes in a sub-cooled state. The former approach resulted in a more costly steam generator, and the latter approach subjected the heat transfer surfaces to deposition of tars which would reduce the rate of heat transfer.

The use of vertically-disposed tubes presents other problems, including the local erosion of the tube surfaces adjacent to the region where the tubes penetrate the horizontally-disposed, air distribution plate caused by the passage of combustion-supporting air through the distribution plate. There are also problems associated with the differences in the coefficients of thermal expansion of the material of the vertical tubes and the material of the air distribution plate, which can result in both thermal and mechanical stress problems.

Horizontally-disposed heat transfer tubes, as well as vertically-disposed serpentine tubes, cannot be used in natural-circulation, steam-generating systems. The former permit premature separation of the vapor from the liquid, thereby subjecting the heat transfer surfaces to localized over-heating. The latter arrangement impedes the natural circulation of the flow of the heat transfer fluid by the untimely separation of the steam and the water in the tube bundle bends, causing vapor locks. Forced circulation must be used with both types of tubes, thus requiring the incorporation of a pump into the steam-generating circuit, and thereby increasing the operating and capital costs of the steam generator.

In an effort to extend the improvement in the heat transfer realized with surfaces immersed in a conventional fluidized bed to surfaces immersed in the gases above the bed, reduce the total heat transfer surfaces required, improve upon the operational turn-down of the boiler, and achieve a reduction in boiler size resulting from an increase in boiler throughput and utilization of natural circulation heat transfer circuitry, a steam generator has been developed utilizing the fast-fluidized bed process. The fast-fluidized bed process consists of an entrained-phase fluidized bed having relatively fine particles of an inert material, such as sand, silica, or the like, suspended within the combustion gases which is superimposed upon a conventional or dense-phase fluidized bed. Under operating conditions, the coarse, high-specific-gravity materials remain adjacent to the air distribution plate to form the conventional or dense-phase fluidized bed, while the fine particles of inert and other materials pass through the dense-phase fluidized bed to form the entrained-phase fluidized bed in the region above the dense-phase fluidized bed. The fine particle materials in the entrained-phase fluidized bed are subsequently captured and returned to the bottom of the dense-phase fluidized bed.

In the fast-fluidized bed process, combustion-supporting air is forced through the air distribution plate and through the fluidized bed at a relatively high velocity to cause the fine particle materials of the fluidized bed to be dispersed upwardly and become mixed with the combustion gases. The coarse particles of the dense-phase fluidized bed retard the upward movement of coal and sulfur sorbent material particles so that these particles remain in the bed for a certain period of time before they are entrained. This retardation characteristic accounts for the excellent fuel combustion and the improved chemical reaction between the sulfur sorbent material and the sulfur oxides present in the combustion gases. Thus, the major functions of the coarse, high-specific-gravity materials in the dense-phase fluidized bed are to enhance the combustion of the fuel and to increase the efficient utilization of the sulfur sorbent material at high gas velocities.

The fast-fluidized bed process offers a unique technique by which the fluidized bed system may be operated at very high gas velocities without the limitation of poor combustion and low efficiencies of sulfur sorbent material utilization as encountered in most of the state-of-the-art fluidized bed systems. The entrained-phase fluidized bed functions to maintain a high heat transfer coefficient between the entrained-phase fluidized bed and the heat transfer tubes disposed therein, whereas in a conventional fluidized bed system, the heat transfer coefficient normally occurring in this region is very low. Steam generating systems have not been developed which are fully able to utilize the unique advantages of the multi-solid, or fast, fluidized bed process, and which avoid the foregoing problems associated with horizontally-and vertically-disposed heat transfer tubes.

SUMMARY OF THE INVENTION

Accordingly, it is an object of the present invention to provide an improved and more efficient steam generating system.

It is another object of the present invention to provide an improved steam generating system which utilizes a fast-fluidized bed process as the source of heat.

Another object of the present invention is to provide an improved steam generating system of the above type having vertically-disposed, heat transfer elements which are not embedded within a conventional, dense-phase fluidized bed.

A further object of the present invention is to provide an improved steam generating system of the above type which operates at high gas velocities, provides greater flexibility during system operations and is more efficient in fuel consumption and material utilization.

Toward the fulfillment of these and other objects, the steam generating system of the present invention includes a furnace having walls constructed of adjoining, vertically-disposed tubes through which a heat transfer medium, such as water, is circulated, and the heat produced by a fast-fluidized bed process is transferred to this medium. The fast-fluidized bed process provides for a conventional, dense-phase fluidized bed supported by a perforated, air distribution plate disposed adjacent to the lower portion of the furnace, which is produced by combustion-supporting air being introduced at a relatively high velocity through the air distribution plate, to fluidize a bed of particulate materials. Fine particles of an inert material become entrained with the combustion gases in the region above the dense-phase fluidized bed to form an entrained-phase fluidized bed. A second set of vertically-disposed, heat transfer tubes are provided in the region above the dense-phase fluidized bed, and heat is transferred thereto from the entrained-phase fluidized bed. A steam drum is disposed above the furnace, and a plurality of downcomers provide circulation of the heat transfer medium through a first circulation circuit formed by the tubes in the walls of the furnace and a second circulation circuit formed by the plurality of heat transfer tubes disposed in the region above the dense-phase fluidized bed.

BRIEF DESCRIPTION OF THE DRAWINGS

The above description, as well as further objects, features and advantages of the present invention, will be more fully appreciated by reference to the following description of a presently-preferred but nonetheless illustrative embodiment in accordance with the present invention, when taken in conection with the accompanying drawings, wherein:

FIG. 2 is a cross-sectional view of the steam generator, taken along line 2—2 of FIG. 1;

FIG. 3 is a fragmentary, perspective view showing a portion of the wall structure of the boiler of the steam generator;

DESCRIPTION OF THE PREFERRED EMBODIMENT

Figure 1:
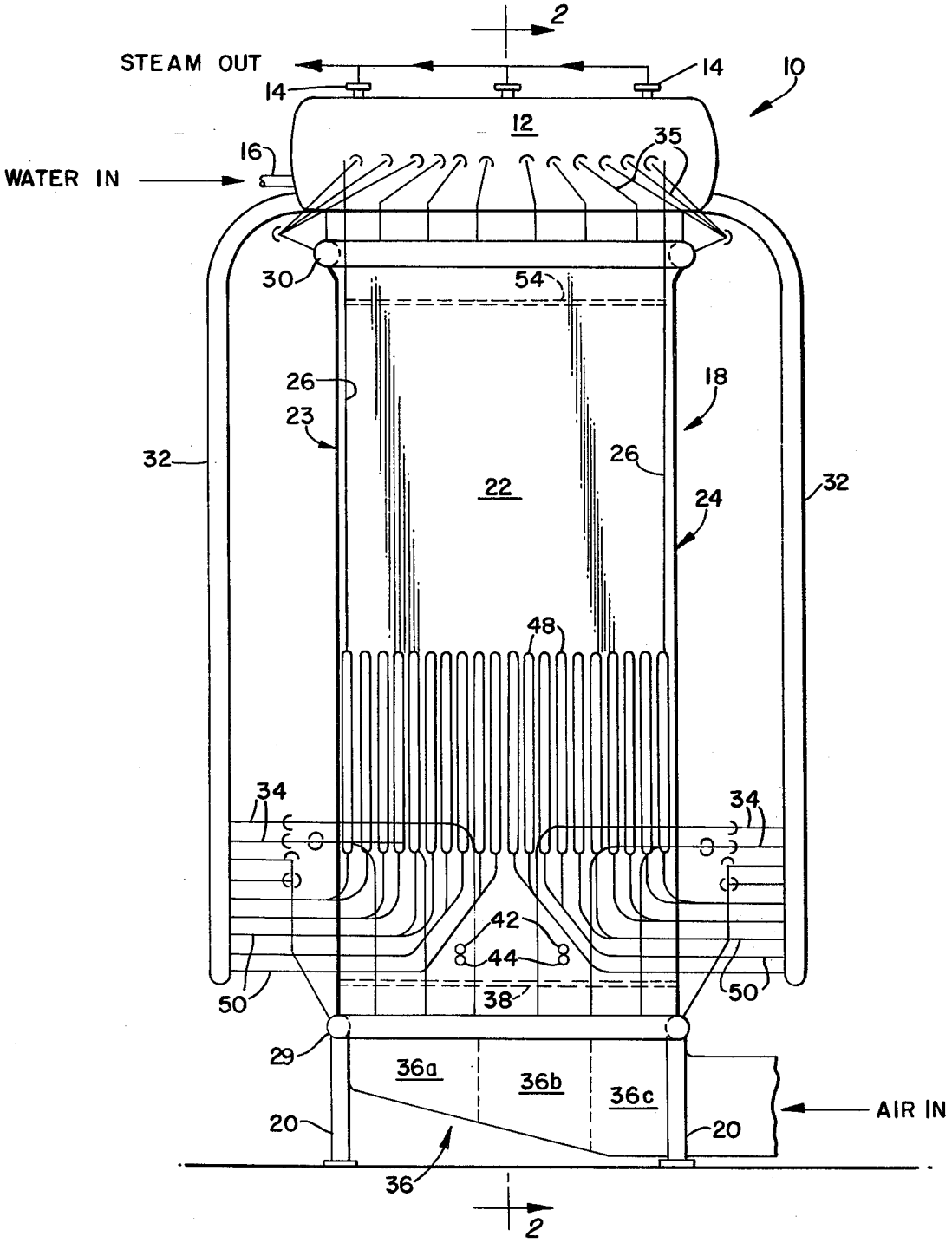
FIG. 1 is a side elevation view showing a steam generator which incorporates a fast-fluidized bed process as the heat source.

Referring to FIGS. 1 and 2 of the drawings, the reference numeral 10 refers generally to a steam generator of the natural-circulation type which uses a fast-fluidized bed process to provide the heat transferred to a heat transfer medium, such as water, circulated through the steam generator. The steam generator 10 includes a steam drum 12 disposed at the upper portion of the steam generator, in which the water and steam are separated from mixtures thereof in a conventional manner, with the separated steam being removed through a plurality of steam pipes 14. A feed pipe 16 supplies water to the steam drum 12 from a supply source (not shown) and maintains a relatively constant level of water within the steam drum. A boiler 18 is disposed below the steam drum 12, and a plurality of legs 20 support the boiler upon a rigid foundation. The boiler 18 includes spaced sidewalls 21 and 22 (FIG. 2), which extends parallel to the central axis of the steam drum 12, and spaced end walls 23 and 24 (FIG. 1), which extend perpendicularly to the sidewalls to form a substantially rectangular furnace 25.

The walls 21–24 of the boiler 18 are of water wall construction, in which a plurality of vertically-disposed tubes 26 are interconnected by vertically-disposed elongated bars, or fins, 28 to form a contiguous, wall-like structure, as better shown in FIG. 3. Some of the tubes are displaced out from the plane of the bars 28 to provide openings for purposes which will be described more fully below. The ends of each of the tubes 26 of the walls 21–24 are connected to horizontally-disposed lower and upper ring headers 29 and 30, respectively, which are shown in FIGS. 1 and 2.

With continuing reference to FIGS. 1 and 2, a pair of downcomers 32 is disposed outside of the boiler 18 and extends downwardly from the ends of the steam drum 12 to conduct unheated water to a lower series of transfer pipes 34 which interconnect the lower portion of the downcomers and the lower ring header 29. An upper series of transfer pipes 35 interconnect the upper ring header 30 with the steam drum 12. A first flow circuit for the water and steam is thus formed by the steam drum 12, the pair of downcomers 32, the lower series of transfer pipes 34, the lower ring header 29, the plurality of tubes 26 in each of the walls 21–24 of the boiler 18, the upper ring header 30, and the upper series of transfer pipes 35. The tubes 26 and the series of transfer pipes 34 and 35 are schematically illustrated in FIGS. 1 and 2. It is understood that appropriate insulation (not shown) would be provided on the exterior surface of the boiler 18 in a conventional manner.

Disposed below the lower ring header 29 is a plenum chamber 36, into which pressurized air from a suitable source (not shown) is introduced by conventional means, such as a forced-draft blower, or the like. The plenum chamber 36 is subdivided vertically into three compartments denoted by the broken lines and identified as **36*a*, 36*b*, and 36*c*, with each compartment containing its own air-flow control damper (not shown) to regulate the flow of air into the combustion chamber of the boiler. It is understood of course that the plenum chamber 36 may be subdivided into more or fewer than three compartments. Subdivision of the plenum chamber 36 permits fluidization of part of the particulate material bed during the start-up procedure, as will be detailed more fully below, and provides the capability of balancing the air flow during operation of the steam generator 10**.

Suitably supported at the lower portion of the combustion chamber of the boiler 18, and disposed above the plenum chamber 36, is a perforated air distribution plate 38, which may be of a segmented design to permit easy installation and removal. Air is introduced into the boiler 18 through the plenum chamber 36 and the air distribution plate 38, and may be preheated by air preheaters (not shown) and appropriately regulated by air control dampers to reduce the air requirement during the start-up procedure.

The lower portion of the furnace 25, i.e., the inner surfaces of the walls 21–24 of the boiler 18, is lined with a refractory, or other suitable insulating material 39, which extends a predetermined distance above the air distribution plate 38 as shown in FIG. 2. The air distribution plate 38 is adapted to support a bed 40 of a particulate material in the furnace 25, consisting of: a relatively-coarse, high-specific-gravity inert material, such as Speculite, the trade name for a commercial-grade, hematite iron ore; crushed coal as the fuel; fine limestone or dolomite as a sorbent material for the sulfur formed during the combustion of the fuel, if the fuel contains relatively large amounts of sulfur; and a relatively-fine, inert material, such as sand or silica.

Four fuel injection ports 42 are provided in the boiler 18, with two located symmetrically in each of the sidewalls 21 and 22 and positioned a short distance above the horizontal level of the air distribution plate 38. Four recycling ports 44 are also provided in the boiler 18, two on each of the sidewalls 21 and 22 located symmetrically with respect thereto, and positioned directly below the horizontal level of the fuel injection ports 42. In each of the spaced end walls 23 and 24, at a horizontal level corresponding substantially to the upper surface of the bed 40 of particulate material, an inlet 45 (FIG. 2) is provided for the introduction of a start-up fuel into the boiler 18. Additional coal and limestone for the bed 40 is introduced through the fuel injection ports 42 during operation of the steam generator 10.

The high-pressure, combustion-supporting air introduced through the air distribution plate 38 from the plenum chamber 36 causes the particles of the relatively-fine inert material to become entrained within the combustion gases, along with the fine particles of coal ash and spent limestone, and to behave essentially as a gas. This mixture of entrained particles and gas, or the entrained-phase fluidized bed, passes through the dense-phase fluidized bed supported by the air distribution plate 38, rises upwardly within the furnace 25, and passes from the furnace through screen sections, the structure of which will be described more fully below. The coal ash and spent limestone are carried to separators and filters (not shown) by the combustion gases, are captured and returned to the bottom of the bed 40 via the recycle ports 44, as will be described more fully below.

Disposed within the furnace 25, above the particulate material bed 40, is a tube bundle constituted by a plurality of vertically-oriented riser tubes 46, which are shown schematically in FIG. 2. The riser tubes 46 are disposed within the furnace 25 in a parallel-row array, and the upper end of each riser tube penetrates the steam drum 12 to introduce a mixture of steam and water. The parallel-row arrangement of the riser tubes 46 are disposed symmetrically with respect to the lateral medial plane (not shown) of the furnace 25, which extends through the central, longitudinal axis (not shown) of the steam drum 12. FIG. 2 shows one row of the riser tubes 46 extending across the width of the boiler 18, with the lower portion of each of the tubes being bent at an angle and extending from the furnace 25 through the sidewalls 21 and 22. The lower portions of one-half of the riser tubes 46, such as those to the left of the lateral medial plane, are bent to the left, and pass through the sidewall 21, while the other half are bent to the right, and pass through the sidewall 22.

To reduce the number of penetrations of the sidewalls 21 and 22 by the riser tubes 46, the lower portions of the tubes in two, adjacent rows are configured to pass through the sideswalls in one, vertically-extending plane. This arrangement is shown schematically in FIG. 2. As noted above, one row of the riser tubes 46 is shown, with the lower portion of each tube being appropriately bent to pass through the sidewalls 21 and 22. The adjacent row of riser tubes, which for example is in a parallel plane above the plane of FIG. 2, also extends vertically within the furnace 25. The lower portion of each of the riser tubes in this adjacent row, however, is bent at an angle of approximately 45° directed into the plane of FIG. 2, and is further bent to the left or the right in this plane to pass through the sidewalls 21 and 22 in the same vertical plane as the riser tubes 46 shown in FIG. 2. The lower portions of the adjacent row of riser tubes are illustrated schematically in FIG. 2 by the lower of the pair of parallel, horizontally-extending lines which is connected to each of the riser tubes 46 and pass through the sidewalls 21 and 22, and are identified as **46*a***.

Figure 4:
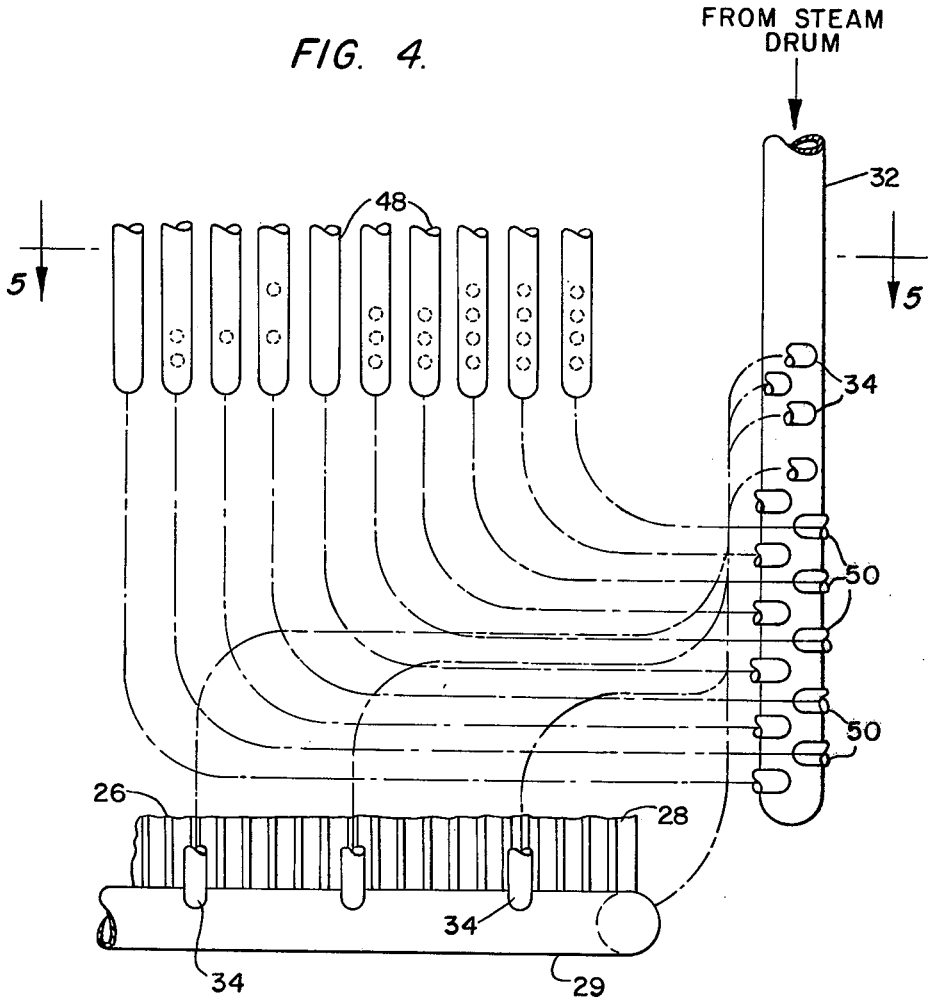
FIG. 4 shows, to an enlarged scale, a lower portion of the steam generator of FIG. 1.

The end of each of the riser tubes 46 and **46*a* which is exterior of the furnace 25 is connected to a header 48, commonly called a "bottle", which is formed as a pipe, closed at the upper end and positioned vertically on the sidewalls 21 and 22. The array of headers 48 on the sidewall 22 may be more clearly seen in FIG. 1. It is understood that a similar configuration of headers 48 is disposed on the sidewall 21. As can be seen in FIGS. 1 and 4, the headers 48 are in fluid communication with the lower portions of the downcomers 32 via a series of riser transfer pipes 50. Conveniently, one-half of the headers 48 adjacent to the end portions of both sidewalls 21 and 22 may be connected to each of the downcomers 32**.

Figure 5:
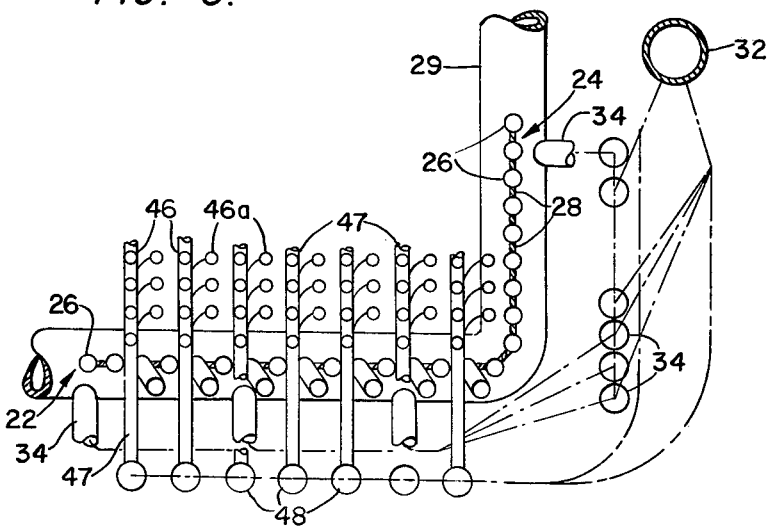
FIG. 5 is a cross-sectional view taken along line 5—5 of FIG. 4.

Alternatively, the riser tubes 46 and 46*a* in two, ajacent rows may be coupled at their lower ends to a connector pipe 47, with the series of connector pipes extending though the sidewalls of 21 and 22 and being coupled to the array of headers 48. FIG. 5 shows the connection of adjacent rows of riser tubes 46 and 46*a* to the connector pipes 47, and the penetration of the sidewall 22 by the connector pipes. The lower end of each of the riser tubes 46 in one row terminates at and is connected to the connector pipe 47. The lower end of each of the riser tubes 46*a* in the adjacent row is bent at an angle, directed towards the left of FIG. 5, and is fluidly connected to the connector pipe 47.

Thus, a second flow circuit for the water and steam in the steam generator 10 is provided by the downcomers 32 from the steam drum 12, the series of riser transfer pipes 50, the plurality of headers 48 and the riser tubes 46 and 46*a* in one embodiment, or with the connector pipe 47 interconnecting the headers and the riser tubes in the other embodiment, with the riser tubes terminating at the steam drum. Heat transferred to the water within the second flow circuit is supplied primarily from the entrained-phase fluidized bed, as will be described more fully below.

Adjacent to the upper portion of each of the spaced sidewalls 21 and 22 of the boiler 18 is a screen section 52 (FIG. 2), which is provided in the sidewalls in a manner better shown in connection with FIG. 3. In particular, the upper portions of every second and third tube 26 forming the sidewalls 21 and 22 are bent outwardly at an angle, as shown by the reference numeral 26*a*, to provide a horizontally-disposed series of alternating slots 26*b* in that area vacated by the bent portion 26*a*. Thus, each of the screen sections 52 is formed by a plurality of the slots 26*b*, which enables the particulate materials in the entrained-phase fluidized bed to pass from the upper region of the furnace 25. An exhaust duct 53 is disposed in receiving relationship adjacent to each of the screen sections 52 to conduct the entrained-phase fluidized bed to particulate material separators (not shown), which function conventionally to separate the particles of limestone and the relatively-fine inert material from the combustion gases. The gases are exhausted to the atmosphere in a conventional manner, and means (not shown) are provided for transporting the separated limestone particles and the relatively-fine inert material to the recycle ports 44 for introduction into the lower portion of the dense-phase fluidized bed.

Also shown in FIG. 3 is the bent-out displacement of alternate tubes 26 in the lower portions of the boiler walls 21–24 to permit penetration by the riser tubes 46 and 46*a* or the connector pipes 47, in which alternate riser tubes are displaced laterally with respect to the original vertical axis of the tubes to form openings 26*c* which permit passage of the riser tubes or the connector pipes 47 from the furnace 25, as shown in FIGS. 1 or 5.

To protect the lower surface of the steam drum 12 from erosion due to inpingment of the recirculating particulate materials in the entrained-phase fluidized bed as the materials leave the furnace 25 via the screen sections 52 and the exhaust ducts 53, a partition 54 is installed in the upper portion of the furnace 18, just below the steam drum, as shown in FIGS. 1 and 2, to provide a shield therefore. The partition 54 may be of any suitable construction, such as a plurality of scalloped-shaped bars (not shown in detail) inserted between the rows of riser tubes 46 and 46*a* and secured to the tube by suitable means, such as tack welding. One side of each of the scalloped-shaped bars is designed to fit the contour of the riser tubes 46 and 46*a* comprising each row, and the other or back side of each bar, where adjacent bars meet, is straight. When properly positioned, a crack remains between the back side of each of the adjacent bars. To seal this crack, a vestibule or penthouse, shown in FIG. 2 by the wall 56, which encloses the lower portion of the steam drum 12 and the upper series of transfer pipes 35, is pressurized with clean air from a source (not shown). The clean air leaks through the cracks formed by the adjacent, scalloped-shaped bars of the partition 54, thus preventing infiltration of the combustion gases and the entrained particulate materials into the vestibule.

In the operation of the steam generator 10, a portion of the particulate material bed 40 supported by the air distribution plate 38 is fired by introducing pressurized air into one of the three compartments 36*a*–36*c* of the plenum chamber 36. A quantity of start-up coal is introduced through the inlet 45 and suitably sprayed over the upper surface of the particulate material bed 40. Since the bundle of riser tubes 46 and 46*a* are positioned above the upper surface of the particulate material bed 40, a space is provided which permits the use of the over-bed feeding method, or the spraying of the start-up fuel over the upper surface of the bed. The use of this over-bed feeding method reduces the auxiliary fuel requirements during start-up of the boiler 18. The coal within the particulate material bed 40 and the start-up coal are ignited by burners (not shown) positioned within the bed and the plenum chamber 36, and as the combustion of the coal progresses, additional air is introduced into the compartment of the plenum chamber 36. The remaining portions of the particulate material bed 40 are fired in the same manner to create the dense-phase and the entrained-phase fluidized beds, as described above. The use of burners in the plenum chamber 36 preheats the air to increase the efficiency of the boiler 18, and thus reduces the consumption of start-up coal.

The entrained-phase fluidized bed rises within the furnace 25 and moves toward the screen sections 52, to be carried through the exhaust ducts 53 into a particulate material separator, such as cyclone. The relatively-fine inert material is separated from the combustion gases within the separator, is cooled therein and recycled back into the lower portion of the dense-phase fluidized bed through the recycle ports 44. The fine limestone particles and the coal ashes which are of such minute dimensions that they pass through the separator, are captured by a second particulate material recovery device, such as a bag housing, which functions as a filter. The combustion gases are exhausted to the atmosphere in a conventional manner, and the separated limestone particles and coal ash are disposed of.

Unheated water introduced into the steam drum 12 through the water feed pipe 16 is conducted downwardly through the downcomers 32. A portion of this water is passed from the downcomers 32, through the lower transfer pipes 34 and the lower header 29, and into the tubes 26 forming the boiler walls 21–24, as described above. Heat from the dense-phase fluidized bed as well as the entrained fluidized bed converts a portion of the water into steam, and the mixture of water and steam rises in the tubes 26, is collected in the upper ring header 30, and is transferred to the steam drum 12 by the upper series of transfer pipes 35. The remaining portion of the unheated water in the downcomers 32 is introduced into the bundle of tubes 46 and **46*a* by the riser transfer pipes 50 and the headers 48 or, alternatively, the transfer pipes 50, the headers 48, and the connector pipes 47. Heat from the entrained-phase fluidized bed converts a portion of the water within the tubes 46 and 46*a* to steam, and this mixture of steam and water is introduced into the steam drum 12 at the upper end of each of the tubes. The steam and water are separated within the steam drum 12 in a conventional manner, and the separated steam is conducted from the steam drum by the steam pipes 14. The separated water is mixed with the fresh supply of water from the feed pipe 16**, and is recirculated through the flow circuits in the manner just described.

A steam generator has thus been disclosed which utilizes to full advantage the unique features of the fast-fluidized bed process. By providing a steam generator with a fast-fluidized bed process as the heat source, and by utilizing vertically-disposed heat transfer tubes, many of the foregoing problems associated with the conventional fluidized bed processes employed in conjunction with either horizontally-disposed heat transfer tubes or vertically-disposed tubes extending through perforated air distribution plates, can be resolved.

Since a separate inert bed material is used as the fluidizing solid, finely-ground limestone or dolomite may be used solely as the sulfur sorbent. This offers the advantage that the system can employ any type of limestone or dolomite as a sorbent material regardless of the physical characteristics of the material, such as attrition resistivity, pore structure, etc.

With the use of high gas velocities in the fast-fluidized bed process, a more honogeneous fluidization of the particulate material in the bed is produced, which insures an excellent, homogeneous gas-solid contact such that a more efficient gas-solid reaction occurs between the sulfur gas produced by the burning of the coal fuel and the sulfur sorbent particles to remove sulfur oxides from the combustion gases. In addition to the advantages obtained by operation at high gas velocities, wide system operation flexibility, such as a high turn-down ratio, can be obtained by operating the steam generator in the conventional dense-phase fluidization mode at much lower air velocities.

Other advantages result from the use of vertically-oriented riser tubes which are not immersed in the dense-phase fluidized bed, as is common practice in the prior art. The vertical orientation of the riser tubes minimizes erosion, reduces the fabrication costs by minimizing the amount of tube bending, and permits the adaption of the fast-fluidized bed process to a natural-circulation steam generator, thereby reducing the energy requirements for circulating the water and the capital and maintenance costs of the circulating pumps. Evaporation of the circulating fluid within the vertical tubes can proceed without the common problem associated with the localized over-heating due to the separation of the liquid and the vapor phases of the heated water within the tubes. The vertical orientation of the tube surfaces also improves the rate at which heat is transferred thereto.

By not immersing the riser tubes in the dense-phase fluidized bed, a space is provided above the bed which permits the use of the over-bed feeding process, which reduces auxiliary fuel requirements during start-up of the steam generator and greatly simplifies the start-up procedure. The removal of the riser tubes from immersion in the dense-phase fluidized bed also greatly simplifies the turn-down procedure for the steam generator, and increases the turn-down ratio available. It is no longer essential that the dense-phase fluidized bed temperature be lowered during turn-down to avoid damage to the tubes immersed therein, as is the conventional practice in the prior art. Since the present steam generator does not require the embedment of riser tubes within the dense-phase fluidized bed, the temperature of the fluidized bed may be maintained constant during the turn-down of the steam generator, which is achieved by reducing the quantity of air flow and fuel flow to the dense-phase fluidized bed.

Locating the steam drum directly over the furnace and adjusting the furnace dimensions to make the overall exterior envelope of the drum and the furnace geometrically compatible further reduces the costs involved in the fabrication and shipping of the steam generator. The length and the bending required of the transfer pipes are reduced. Also, the use of relatively-short length, vertically-disposed lower headers or bottles in place of the conventional, large-diameter, horizontally-disposed headers reduces the overall dimensions of the steam generator, making for a more compact shipping envelope, which further reduces costs and eliminates some of the problems normally associated with the shipment of large size steam generators. The use of the lower and upper ring headers, and the lower and upper series of transfer pipes, respectively, permits manifolding of the unheated water from the two downcomers to the plurality of tubes in the walls of the boiler and reduces the number of penetrations by the tubes into the sidewall of the steam drum.

Although not specifically illustrated in the drawings, it is understood that other additional and necessary equipment and structural components will be provided, and that these and all of the components described above are arranged and supported in an appropriate fashion to form a complete and operative system.

Of course variations of the specific construction and arrangement of the fast-fluidized bed steam generator as disclosed above can be made by those skilled in the art without departing from the invention as defined in the appended claims.

What is claimed is:

1. A heat exchange system comprising:

a boiler having a combustion chamber and a first series of heat transfer elements disposed around the periphery of said combustion chamber;

a layer of heat generating materials disposed adjacent to the lower portion of said boiler, and including a fuel material and an inert material;

a second series of heat transfer elements disposed within said chamber and above said layer of heat generating materials to define a space between the surface of said layer and said second plurality of heat transfer elements;

means for introducing combustion supporting air at an increased velocity through said layer of heat generating materials to support the combustion of said fuel material and to fluidize said layer into a dense-phase fluidized bed of relatively coarse materials, said increased velocity air entraining particles of said inert material in the space above said layer to provide heat to said second series of heat transfer elements;

a plurality of aligned slots formed by the angular displacement from the plane of said combustion chamber of selected ones of said first series of heat transfer elements for permitting the removal of said entrained particles from said combustion chamber; and an exhaust duct in communication with said plurality of aligned slots.

2. The heat exchange system of claim 1, further comprising a source of heat transfer fluid coupled to said first and second series of heat transfer elements.

3. The heat exchange system of claim 1, further comprising a perforated support means for supporting said layer of heat generating materials.

4. The heat exchange system of claim 1, wherein said layer of heat generating materials further comprises a second inert material having a coarser composition than said inert material which remains in said dense-phase fluidized bed during combustion of said fuel material.

5. The heat exchange system of claim 2, further comprising:

first connecting means providing fluid communication between said source of heat transfer fluid and said first series of heat transfer elements; and second connecting means providing fluid communication between said source of heat transfer fluid and said second series of heat transfer elements.

6. The heat exchange system of claim 5, wherein said first connecting means include:

a fluid conduit connected to said source of heat transfer fluid;

a first manifold connected to said first series of heat transfer elements;

a second manifold connected to said first series of heat transfer elements; and separate coupling means for joining said fluid conduit to said first manifold and for joining said second manifold to said source of heat transfer fluid.

7. The heat exchange system of claim 5, wherein said second connecting means include:

a fluid conduit connected to said source of heat transfer fluid;

a plurality of tubes vertically disposed on said boiler and in fluid communication with said fluid conduit; and connector means providing fluid communication between said tubes and said second series of heat transfer elements.

8. The heat exchange system of claim 1, wherein said first and said second series of heat transfer elements comprise vertically-disposed elements.

9. The heat exchange system of claim 1, further comprising inlet means disposed on said boiler for supplying additional fuel material into the space between the surface of said layer of heat generating materials and said second series of heat transfer elements.

10. A steam generator comprising:

a boiler having a series of tubular heat transfer elements, each of said elements being laterally interconnected by elongated members and disposed to form a combustion chamber;

a steam drum in fluid communication with said heat transfer elements for providing a heat transfer fluid;

a layer of heat producing materials disposed adjacent to the lower portion of said boiler, and including a fuel material and an inert material;

a second series of tubular heat transfer elements in fluid communication with said steam drum and vertically-disposed within said combustion chamber above the surface of said layer;

means for introducing combustion supporting air at an increased velocity through said layer of heat producing materials to support combustion of said fuel material and to fluidize said layer into a dense-phase fluidized bed of relatively coarse materials, said increased velocity air entraining particles of said inert material in the space above said layer to provide heat to said second series of heat transfer elements;

a plurality of aligned slots formed by the angular displacement from the plane of said combustion chamber of selected ones of said series of heat transfer elements for permitting the removal of said entrained inert particles from said combustion chamber; and an exhaust duct in fluid communication with said plurality of aligned slots.

11. The steam generator of claim 10, wherein said steam drum is disposed adjacent to the upper portion of said combustion chamber, and further includes partition means shielding said steam drum from the entrained inert particles.

12. The steam generator of claim 10, further comprising perforated support means supporting said layer of heat producing materials and permitting passage of the combustion supporting air, and said means for introducing said air includes a plenum chamber disposed below said support means.

13. The steam generator of claim 10, further comprising:

downcomers extending from said steam drum;

first manifold means in fluid communication with said downcomers for supplying heat transfer fluid to said first series of heat transfer elements; and second manifold means coupled to said first series of heat transfer elements and said steam drum for returning the heat transfer fluid to said drum.

14. The steam generator of claim 10 further comprising:

downcomers extending from said steam drum;

a plurality of tubes vertically disposed on said boiler and in fluid communication with said downcomers; and connectors joining said plurality of tubes with said second series of heat transfer elements.

15. The steam generator of claim 10, wherein said layer of heat producing materials includes a second inert material having a coarser composition than said inert material and which remains in said dense-phase fluidized bed during combustion of said fuel material.

16. A steam generator comprising:

a boiler having a series of tubular heat transfer elements, each of said elements being laterally interconnected by elongated members and disposed to form a combustion chamber;

a steam drum in fluid communication with said heat transfer elements for providing a heat transfer fluid;

a layer of heat producing materials disposed adjacent to the lower portion of said boiler, and including a fuel material and an inert material;

a second series of tubular heat transfer elements in fluid communication with said steam drum and vertically-disposed within said combustion chamber above the surface of said layer;

means for introducing combustion supporting air at an increased velocity through said layer of heat producing materials to support combustion of said fuel material and to fluidize said layer into a dense-phase fluidized bed of relatively coarse materials, and air entraining particles of said inert material in the space above said layer to provide heat to said second series of heat transfer elements; and inlet means disposed in said boiler for the spray feeding of additional fuel material into said combustion chamber, said fuel material being sprayed onto the surface of said layer and into the space between said layer and said second series of heat transfer elements.

17. A heat exchange system comprising:

a furnace section;

means for supporting a bed of particulate material containing fuel in the lower portion of said furnace section;

a first series of vertically extending tubes forming the boundary walls of said furnace section;

a second series of vertically extending tubes disposed within said furnace section with each tube extending from the lower portion of said furnace section above said bed of particulate material to the upper portion of said furnace section;

means for passing a heat exchange fluid in a first fluid flow circuit including said first series of tubes and in a second fluid flow circuit including said second series of tubes; and means for passing air through said bed of particulate material to promote the combustion of said fuel material and add heat to the exchange fluid passing through said tubes.

18. The system of claim 17, wherein said passing means comprises a steam drum disposed above said furnace section, at least one downcomer extending from said steam drum, header means communicating with the upper ends and the lower ends of said first series of tubes, and a plurality of connector tubes connecting said header means to said steam drum and to said downcomer to form said first fluid flow circuit.

19. The system of claim 18, wherein said passing means further comprises means connecting said downcomer to said second series of tubes to form said second fluid flow circuit.

20. The system of claim 19, wherein said connecting means comprises a plurality of additional headers disposed adjacent at least one of said boundary walls, and means connecting said additional headers with said downcomer, said second series of tubes penetrating said latter boundary wall and connecting with said additional headers.

21. The system of claim 19, wherein said connecting means comprises a plurality of additional headers disposed adjacent at least one of said boundary walls, and means connecting said additional headers with said downcomers, and a plurality of horizontally disposed connector pipes extending through said latter boundary wall and connecting said additional headers to said second series of tubes.

22. The system of claim 17, wherein said air passing means is adapted to pass said air through said bed of particulate material at a velocity sufficient to support the combustion of said fuel material, to fluidize the relatively coarse materials, and to entrain the relatively fine materials in the space above said bed to provide heat to the heat exchange fluid passing through said second series of tubes.

23. The system of claim 17, further comprising means connecting adjacent tubes of said first series of tubes along their lengths to form gas tight boundary walls.

* * * * *